US006280230B1

(12) United States Patent
Takase et al.

(10) Patent No.: US 6,280,230 B1
(45) Date of Patent: Aug. 28, 2001

(54) ELECTRICAL TERMINAL

(75) Inventors: Hisato Takase, Machida; Masanori Yagi, Ebina; Naoya Matsuura, Kanagawa; Junnichi Miyazawa, Yokohami, all of (JP)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 09/511,026

(22) Filed: Feb. 23, 2000

(30) Foreign Application Priority Data

Mar. 1, 1999 (JP) ..... 11-053175

(51) Int. Cl.[7] ..... H01R 14/24
(52) U.S. Cl. ..... 439/397; 439/395
(58) Field of Search ..... 439/397, 395, 439/396, 398, 399, 400

(56) References Cited

U.S. PATENT DOCUMENTS 4,040,705 * 8/1977 Huber ..... 339/99 R

* cited by examiner

*Primary Examiner*—Gary Paumen
*Assistant Examiner*—Alexander Gilman
(74) *Attorney, Agent, or Firm*—Charles S. Cohen

(57) ABSTRACT

An improved insulation displacement terminal is formed by punching it from a metal blank. The terminal is folded upon itself to form distinct first and second body portions, each of which ends in an upright line-contacting element. The folded over portion of the terminal defines a first contact beam while a second contact beam extends from alongside the terminal and posses underneath the first contact beam to form a terminal-receiving passage therein for an opposing connector terminal.

19 Claims, 9 Drawing Sheets

ELECTRICAL TERMINAL

BACKGROUND OF THE INVENTION

The present invention relates to insulation displacement terminals used in electrical connectors, and more particularly, to an insulation displacement terminal that facilitates reduction in size and cost and assembly of electrical connectors.

An insulation displacement terminal is widely known as useful in effecting connections between electrical wires and opposing connectors without requiring the soldering of the wires to terminals. Such terminals include slots in which the wires are pressed, and the sides of the slot bite into the outer insulation covering of the wire and into contact with the inner conductive core of the wire to obtain a reliable and a gas tight connection. Such insulation displacement type terminals are useful in reducing the size of the connector and in weight reduction and in reduction in cost of the connector. Insulation displacement terminals are also renown for their ease and superiority of assembly and reliability. Therefore, insulation displacement type terminals have been extensively used as a female terminals of electric connectors.

FIG. 12 illustrates a known insulation displacement type terminal which reduces the amount of material used and which is inexpensive to produce and easy to assemble. FIG. 13 illustrates a known female connector into which such a insulation displacement type connector is assembled, as is shown in Japanese Utility Model Application Laid-Open No. Hei 2-101468.

The terminals 150 shown in this known terminal and connector are of a female type and are provided with a pair of wire-contacting elements, or slotted tabs, 151 & 152 that form conductive terminal portions and are also provided with two terminal contact portions 153 & 154 that are positioned parallel to each other to form a pair of terminal beams. The wire-contacting elements 151 & 152 are connected to each other through a linking, or connecting, body portion 155 which is shown as parallel with the terminal contact portions 153 & 154. In mating with an opposing connector, a male terminal 160 of the opposing connector (not shown) includes a pin terminal that is inserted in between the connecting body portion 155 and the terminal contact portions 153 & 154. The wire-contacting elements 151 & 152 have respective slots 511 & 521, that receive an electrical wire 156 therein. Displacement of the insulation of the wires occurs when the wires are placed into the slots 511 & 521 so that the wire 156 is electrically connected to the terminal 150.

As shown in FIG. 13, the terminal 150 is assembled into a connector housing 170. A plurality of terminal-receiving recesses 171 are arranged in the connector housing 170 and receive wires 156 in a parallel arrangement so that a variety of female connectors containing different numbers of wires and terminals may be formed.

As shown in FIG. 14, for example, such a terminal 150 is manufactured by punching out a conductive plate 501 to obtain the base shape of the terminal 150 and thereafter bending parts thereof to form the final terminal 150. Thus, the width W1 and the width of the connector housing recess 171 are identical with each other. As a result, the overall width dimension W1 of the terminal 150 is reduced to where it is substantially the same as that of each of the wire-contacting elements 151 & 152 so that the material of the conductive plate 501 is effectively used in the construction of the terminal 150.

In this regard, for example, a female terminal 150A having the shape shown in FIG. 15 takes a form such that the terminal contact pieces 153 & 154 are arranged on both sides of the wire-contacting elements 151. Accordingly, the overall width W2 of the terminal 150A is greater than the width W1 of the two wire-contacting elements 151 & 152. Therefore, the conductive material of the terminal 150A is not economically utilized in such a terminal construction.

Returning to FIG. 12, and the terminal 150 illustrated therein, although the conductive material is effectively utilized to effectively attain a reduced size and reduced weight aspects, the terminal 150 suffers from the following problems. First of all, there is a room to further improve the efficiency of utilization of the conductive material that makes up the terminal. Namely, when produced as a mass in conjunction with a carrier strip, such as that shown in FIG. 14, a plurality of terminals 150 are connected in chain-like arrangement to each other by a terminal carrier strip 502. However, the portion of the conductive plate 501 corresponding to the spacing with a width of W3 between the adjacent terminals 150 of the carrier strip 502 must be punched out. This portion is sent to scrap and is wasted in the manufacture of the terminals.

This punched-out portion corresponds to the interval, or spacing, that is disposed between the respective terminal-receiving recesses 171 of the connector housing 170. This portion is required to align the respective terminals 150 on their pitch P1 with their respective connector housing recesses 171 when the terminals 150 are simultaneously assembled from their carrier strip 502 into the connector housing 170 and its associated recesses 171. Secondly, a problem occurs the ability to connect the wire(s) 156 to the terminal 150. Because the terminals 150 are received in a like plurality of respective connector housing recesses 171, the wires 156 are simultaneously inserted from above the terminals into the two slots 511 and 521 that are formed in the wire-contacting elements 151 & 152 to obtain the desired pressed, insulation-displacement connection. However, as shown in FIG. 13, a space having a desired interval is required between the wire-contacting element 151 located on the front end side of the wire 156 and a front end face 711 of the connector housing recess 171. This is because a desired length of the wire with its insulative covering 561 must be left at the front end of the wire 156 and also that it is necessary to keep a good working space of the connector housing into which a terminal press jig may be inserted. With such a space, it is possible to perform a good press connection of the wire 156 to the terminal 150.

However, with the terminal having such a structure, the interval between the wire-contacting elements 151 & 152 is substantially the overall length of the terminal, and in instances where the length of the connector housing recess 171 is identical with the length of the terminal, it becomes difficult to keep such a space in the structure. For this reason, and as shown in FIG. 13, the length of the receipt recess 171 must be longer than the length of the terminal 150, typically by the length of the space. Accordingly, it will be understood that although the terminal 150 per se may be reduced in size, the overall connector housing 170 is not so reduced in size.

Thirdly, it is important and desired to keep an effective contact length between the female terminal 150 and opposing contacts 160 of an opposing male terminal. In the known structure illustrated, the effective contact length of the terminal 150 is shortened as the overall length L of the female terminal 150 is shortened and the female terminal is reduced in size. For this reason, in this structure, there is a limit to the reduction in size that can be attained with such a terminal 150. Fourthly, a problem occurs with the three-point contact terminal that is established by the terminal contact pieces 153 & 154 and the body portion 155 of the terminal. In order to attain good and reliable three-point contact with this known terminal 150, it is necessary to perform extremely high precision machining in comparison with a terminal that has a two-point contact arrangement by clamping the associated terminal on both sides.

The present invention is directed to a terminal construction that avoids these shortcomings and overcomes these disadvantages.

SUMMARY OF THE INVENTION

It is therefore a general object of the present invention to provide a terminal having an improved structure that optimizes the use of the conductive material of the terminal and which applied a good and reliable contact force to a terminal of an opposing connector.

Another object of the present invention is to provide a terminal structure that enhances the use of conductive material while forming the terminals, yet maintaining a preferred reduction in size of the terminal without sacrificing any contact integrity thereof.

Still another object of the present invention is to provide an improved insulation displacement terminal that enhances the assembling of the terminal and maintains an effective terminal length for the terminal, so as to permit the size of the connector housing to also be reduced.

Yet a further object of the present invention is to provide an improved insulation displacement terminal having a pair of insulation displacement portions formed thereon, one of the insulation displacement portions being folded upon a body portion of the terminal in order to obtain a predesired spacing between the insulation displacement portions, and to double up the thickness in the body portion, the doubled up body portion serving as a first contact portion of the terminal, while an arm extending from the body portion serves as a second contact portion of the terminal, the first and second contact portions cooperating to provide a good and reliable contact with a contact portion of a terminal of an opposing connector.

The present invention accomplishes these objects by virtue of its novel and unique structure. In a first principal aspect of the present invention, a connector is provided having a terminal of the insulation displacement type, the terminal having two contact portions extending generally parallel with each other with a preselected spacing disposed therebetween, and a pair of wire-contacting elements, each of the elements having a slot for receiving a portion of an electrical wire therein. An associated terminal of an opposing connector is inserted into the space between the two contact portions of the terminal to obtain an electrical connection between two connectors. The terminal includes a body portion that is stamped from a conductive metal blank, with part of the body portion being folded upon itself so that the folded-back portion extends along a surface of the terminal body portion and defines a curved lead-in portion of the terminal. The folded back part of the terminal body portion in effect defines a first contact beam or portion of the terminal, while an arm or leg portion extends from the terminal body portion widthwise thereof and then along and underneath the terminal body portion to define a second contact portion of the terminal that is spaced apart from the folded back portion, the two contact portions cooperatively defining a two-point contact arrangement for an opposing connector terminal.

The presence of the folded-back portion of the terminal in the first contact portion strengthens the spring force in that first contact portion so that the terminal may achieve a good and reliable two-point contact with a simple terminal structure in which the opposing terminal is clamped between the first and second contact portions of the terminal. One of the insulation displacement portions rises up from the folded-back portion, so that it is possible to keep a desired spacing between the first wire-contacting element and the end portion of the first contact portion of the terminal. This folded back portion assists in resisting the force of the wire pressing member and therefore contributes to an enhancement in workability of assembly of the wires to such a connector, while reducing the size of the terminal by reducing the interval between the wire-contacting elements.

In accordance with a second principal aspect of the present invention, the second contact portion of the terminal includes a suspension portion that extends generally perpendicular to the terminal body portion near a rear portion of the terminal body portion, and a contact beam that is generally horizontal and which extends toward the free end of the terminal from its suspension portion. This contact beam terminates in a contact end that has a contact surface formed thereon which opposes the first contact portion that is formed by the folded back portion of the terminal. This contact surface is located centrally across the second contact portion and extends widthwise of the terminal body portion. With such an arrangement, a sufficiently effective, yet small length of the first contact portion (the folded-over portion) may be maintained, yet it is possible to increase the effective contact length between both contact portions and the opposing connector terminal. The contact surface is located centrally in the widthwise direction and faces the first contact portion of the terminal so that good and reliable electrical contact is ensured with an opposing connector.

In a third principal aspect of the present invention, the first and second contact portions each have curved lead-in surfaces. One of the curved lead-in surfaces is formed by the edge of the folded-over body portion, while the other of the curved lead-in surfaces is formed at the end of the second contact portion. The curved edge formed by the folded-over portion serves as a lead-in surface for introducing an associated terminal of an opposing connector between the two contact portions. By forming the folded-back portion, it is possible to simultaneously form in the terminal, a lead-in surface to facilitate entry of a terminal of an opposing connector.

In a fourth principal aspect of the present invention, the terminal further has a second lead-in surface formed on its second contact portion at the front edge thereof and spaced apart from the aforementioned lead-in surface. Both of these lead-in surfaces cooperate to introduce the terminal(s) of the opposing connector into contact with the terminal between the two contact portions of the terminal. The curved lead-in surfaces smooth the insertion process. The contact beam of the second contact portion has an offset portion that aligns the second lead-in surface with the first lead-in surface and which strengthens the spring force of the contact beam.

In a fifth principal aspect of the present invention, the length of the folded-back portion is at least equal to one fourth of the length of the terminal body portion. It length may be more, but one-fourth of the length is preferable. With this length, the folded-back portion may be more effectively exhibited to thereby miniaturize the terminal, enhance the press-terminal workability and maintain the effective terminal length and the like.

These and other objects, features and advantages of the present invention will be clearly understood through consideration of the following detailed description.

BRIEF DESCRIPTION OF THE DRAWINGS

In the course of this description, reference will be made to the attached drawings in which.

DETAILED DESCRIPTION OF THE PREFERRED EMBODIMENTS

Figure 1:
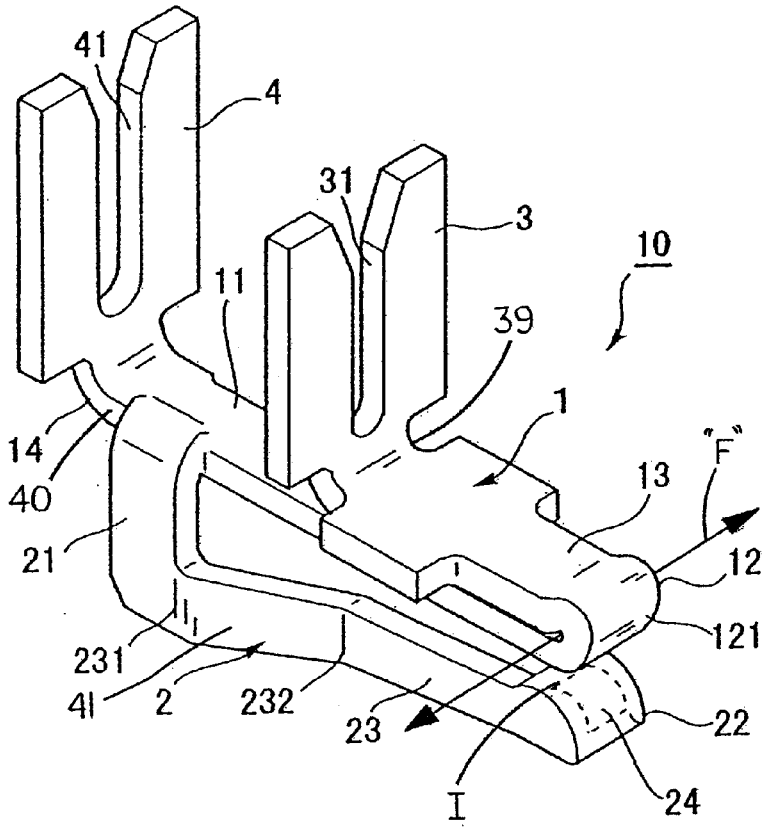
FIG. 1 is a perspective view of a insulation displacement type terminal constructed in accordance with the principles of the present invention.
Figure 2:
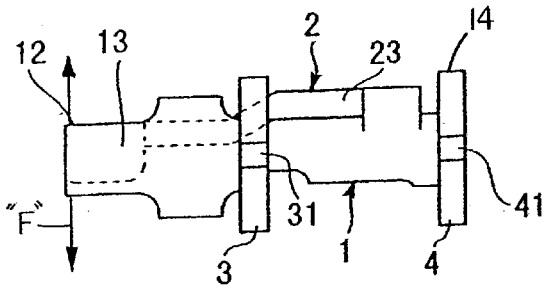
FIG. 2 is a top plan view of the terminal of FIG. 1.
Figure 11:
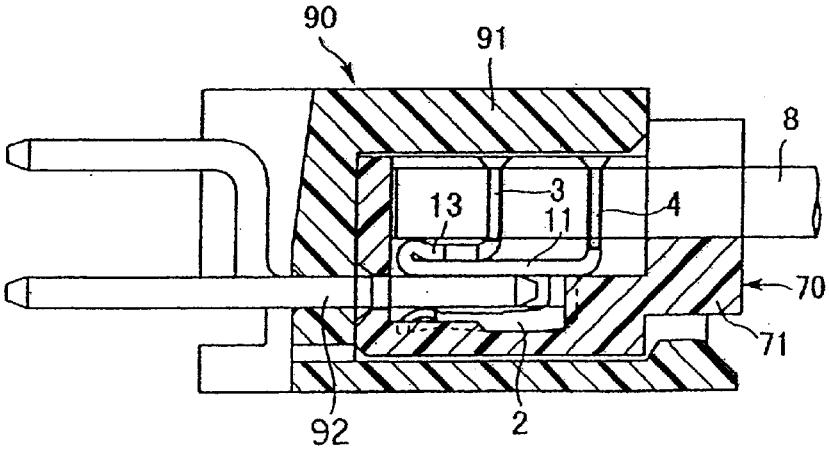
FIG. 11 is a cross-sectional view of the connector housing of FIG. 7 with terminals of the type shown in FIG. 1, mated with an opposing connector, illustrating the manner on engagement between the respective terminals of the two connectors.
Figure 12:
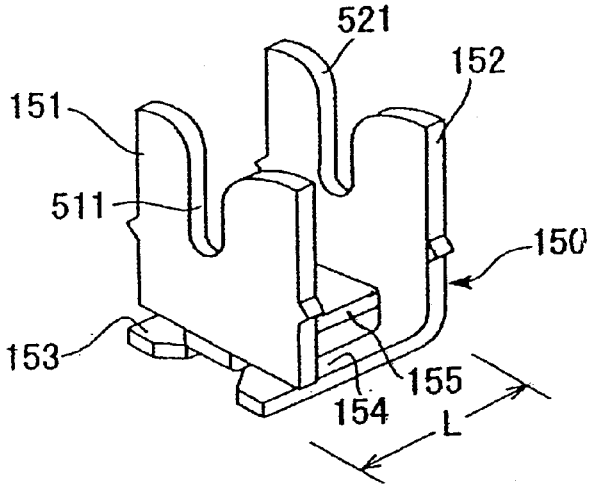
FIG. 12 (PRIOR ART)
FIG. 12 is a perspective view of a conventional insulation displacement terminal.
Figure 13:
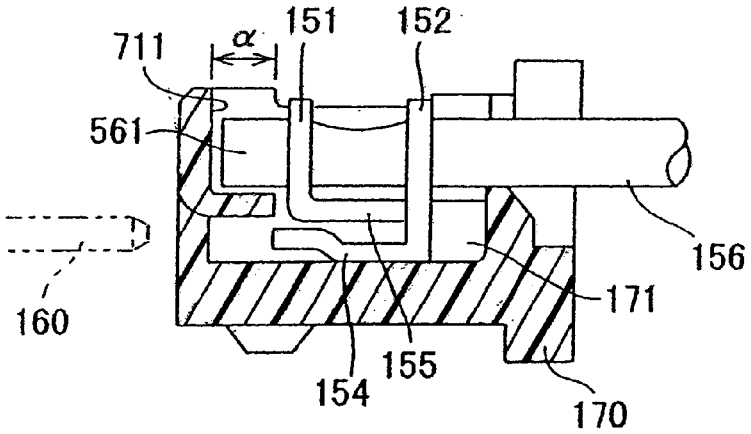
FIG. 13 (PRIOR ART)
FIG. 13 is a cross-sectional view of a connector housing with a conventional insulation displacement terminal in place within the connector housing and connected to a wire.
Figure 14:
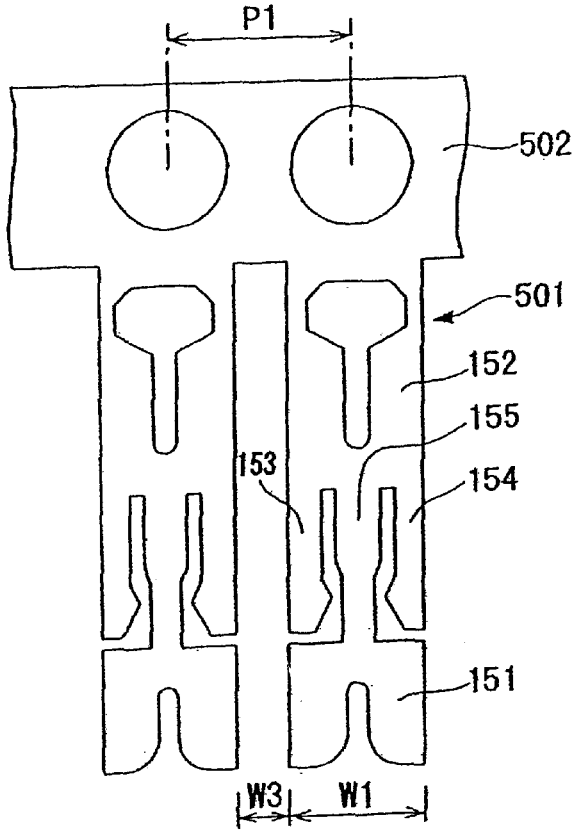
FIG. 14 (PRIOR ART)
FIG. 14 is a top plan view of a carrier strip holding a plurality of showing a developed shape of the conventional terminal.
Figure 15:
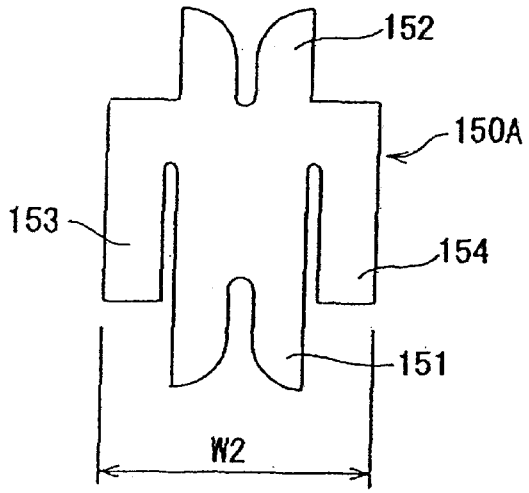
FIG. 15 (PRIOR ART)
FIG. 15 is a top plan view of a metal blank illustrating the shape of another conventional insulation displacement terminal, prior to bending of the terminal.

FIG. 1 illustrates an insulation displacement type terminal 10 constructed in accordance with the principles of the present invention. The terminal 10 can be seen to be formed from a single piece of conductive material, such as a metal, and is provided with two contact portions, referred to hereinafter as contact beams 1 and 2 that extend alongside each other in a generally parallel relationship with an intervening space I therebetween. A pair of wire-contacting members 3, 4 are provided as part of the terminal and these wire-contacting elements are of the slotted type that receive therein, an insulated wire and form an electrically conductive relationship with the inner conductor(s) of the wire. This insulation displacement type terminal 10 as a whole is made of conductive metal (i.e., conductive plate) so that it will electrically contact an associated mating terminal of an opposing connector that is inserted from between the respective end portions 12 and 22 of the terminal contact beams 1 and 2 to maintain the electrical connection between the terminal 1 and the opposing terminal 92 (FIG. 11).

Figure 3:
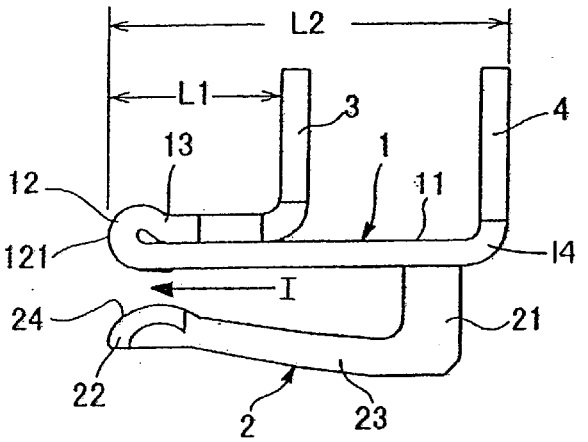
FIG. 3 is a side elevational view of the terminal of FIG. 1.
Figure 4:
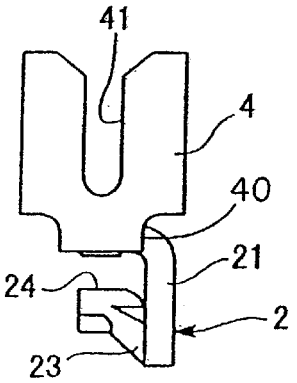
FIG. 4 is a rear elevational view of the terminal of FIG. 1.
Figure 16:
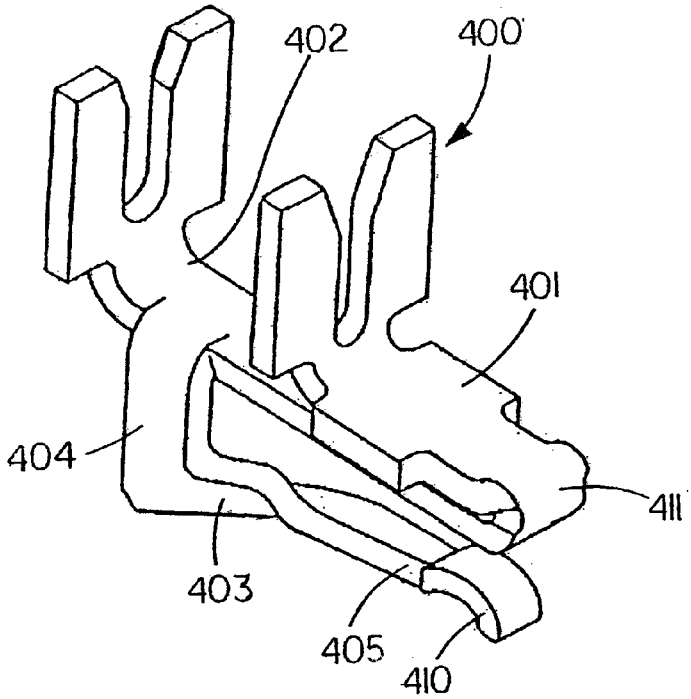
FIG. 16 is a perspective view of another embodiment of a terminal of the present invention; and, FIG. 17 is a bottom plan view of the terminal of FIG. 16.

Although the terminal 1 may be considered as being formed from a single piece of conductive metal, it is, as shown in FIGS. 1, 3 and 16, folded upon itself along a preselected dividing line F, that, for the purposes of this description may be considered as defining two body portions 11, 13 of the terminal. One of the body portions, a second body portion 11, has a wire-contacting element 4 formed thereon and extending upwardly therefrom. This wire-contacting element 4 is formed at a second end 14 of the second body portion 11. The other of the two body portions, a first body portion 13 also has a wire-contacting element 3 formed therein and extending upwardly therefrom. This wire-contacting element 3 is likewise formed at a second end 39 of the first body portion 13.

The first body portion 13 is folded upon the second body portion 11 lengthwise and in a manner such that their respective wire-contacting elements 3, 4 are aligned with each, and including the respective wire-receiving slots 31, 41 thereof. In the preferred embodiment, the two body portions 13, 14 will have different lengths of respective lengths L1 and L2 that, when combined, correspond to the full length of the terminal 10. Preferably, the length L1 of the first body portion 13 is between about one-half (about 50%) and about one-third (about 33%) of the length L2 of the second body portion 11. These relationships will correspond to the second body portion length L2 being approximately between about one-third (about 33%) and about one-fourth (about 25%) of the total length of the two body portions combined.

As described later, the greater the length L1 of the first body portion 13, the smaller the interval between the wire-contacting elements 3 and 4 becomes. Accordingly, it is preferable to set the length L1 of the first body portion 13 to be equal to or less than one-half of the length L2 of the second body portion 11 in order to keep a balance between the appropriate lengths and the intervals between the two wire-contacting elements 3, 4.

The second terminal contact beam 2 projects from the side of and near the rear of the second body portion 11, specifically from one edge portion 40 thereof In order to facilitate the stamping of the terminals, the second contact beam 2 has a leg or suspension portion 21 formed with the second body portion 11, and spaced apart from the rear end 14 of the second body portion 11. This leg portion 21 acts to suspend the second contact beam 2 substantially at a right angle on the side of the terminal in a cantilevered fashion and near the rear 14 of the second body portion 11. The second contact beam 2 further includes an arm portion 23 that runs generally lengthwise of and generally parallel to the two body portions 2, 13 of the terminal. A curved entry surface 24 may be provided at the free end, or tip, 22 of the second contact beam 2 and it extends generally transverse to the axis of the second contact beam 2. This contact surface 24 is preferably coined, or otherwise formed, to facilitate mating to an opposing terminal 92 associated with an opposing connector 90. This curved contact surface 24 is preferably disposed in the central portion of the second contact beam and in alignment and opposition to the contact surface 121 of the first contact beam 1.

The leg portion 21 and the horizontal, or contact arm, portion 23 are formed together in an L-shape as viewed from the side. However, and importantly, the contact arm portion 23 has a unique shape that includes a transition portion 41 that is bent at two locations, i.e., at a first bending portion 231 and a second bending portion 232, by which the contact arm "jogs" over from the leg portion to its preferred position under the first contact beam 1. The first bending portion 231 is generally located at a border between the leg portion 21 and the contact arm portion 23, while the second bending portion 232 is located along the length of the contact arm portion 23. The first bending portion 231 is formed for shifting the contact arm portion 23 toward the second body portion 11. The second bending portion 232 is formed for directing the contact arm portion 23 in its extent from the second bending portion 232 to its free end 22 and contact surface 24 along the second body 11. This offset structure will serve to stiffen the second contact beam 2 and increase its spring force characteristics when it is deflected under loading by the opposing connector terminals 92 as compared to an entirely straight contact beam 2.

The terminal surface 24 has a width that is substantially the same as the width of the free end portion 12 of the first contact beam 1. Furthermore, the terminal surface 24 is formed in a curved surface, and preferably with an arcuate shape in cross-section. This curved surface 24 also serves as a guide surface for assisting the insertion of the associated opposing connector terminal. The curved surface is typically formed by the bending process.

One wire-contacting element 3 rises from the first body portion 13 and projects substantially perpendicular to the surface of the second body portion 11, while the other wire-contacting element 4 rises in the same upright direction at the other end 14 of the second body portion 11 to project substantially perpendicular to the surface of the second body portion 11 in the same manner. Respective slots 31 and 41 are formed in these wire-contacting elements 3 and 4 for displacement of the insulation of the wires 8 inserted into the terminals 10.

As mentioned above, the first body portion 13 is folded back through 180° and upon the second body portion 11 so that the free end 12 of the first contact beam 1 is formed with a curved portion. That serves as a guide surface 121 that is spread apart from and aligned with the contact and guide surface 24 of the second contact beam 2.

Figure 5:
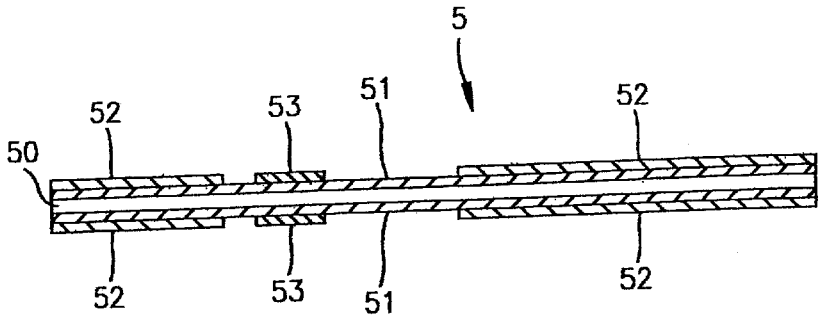
FIG. 5 is a cross-sectional view of a conductive metal strip that has been selectively plated prior to stamping the terminal of FIG. 1 out of the plate.

The terminal 10 is manufactured by punching it out of and bending a conductive metal plate as shown in FIG. 5. This conductive plate 5 is obtained by plating a metal plate 50 of phosphorous bronze or other similar metal. The conductive plate 5, as illustrated in FIG. 5, has first plated layers 51, second plated layers 52 and special plated layers 53, for example.

The first plated layers 51 are made of, for example, a nickel plating material (Ni) which is applied to the overall surface of the front and rear faces of the metal plate 50. Tin-lead soldering plating material (SnPb) maybe used to form the second plated layers 52 and is applied mainly to the portions which are to be formed into the wire-contacting elements 3 and 4. A gold plating (Au) is used to form the special plated layers 53 and applied to the portion which are to be formed into the curved surface 24 of the second contact beam 2.

Figure 6:
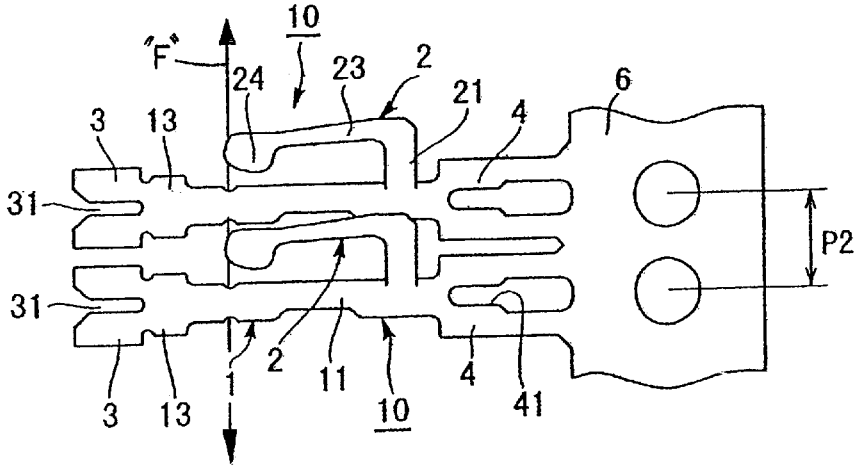
FIG. 6 is a plan view of a carrier strip carrying a plurality of stamped forms that are used to form the terminal of FIG. 1.

FIG. 6 shows a portion of a carrier strip 6 containing a plurality of terminals 10 connected together in a chain fashion by the terminal carrier strip 6. The terminals 10 are illustrated after the metal blank 5 has been punched. As understood from FIG. 6, the other terminal beam 2 is provided for each single terminal 10 and is formed only on one side by punching. Under this condition, the arrangement pitch P2 of each terminal 10 is designed in advance so that it is the same as the arrangement pitch of each terminal-receiving recess 72 formed in the connector housing 71 of the female connector 70 show in FIG. 7. Because the second contact beam 2 is provided only on one side of the terminals 10, the pitch of the terminals 10 may be reduced as compared to the prior art terminals of FIGS. 12–15, wherein contact beams are provided on both sides of the terminals. Additionally, the material in the terminals of the present invention is effectively utilized better than in the prior art.

Figure 7:
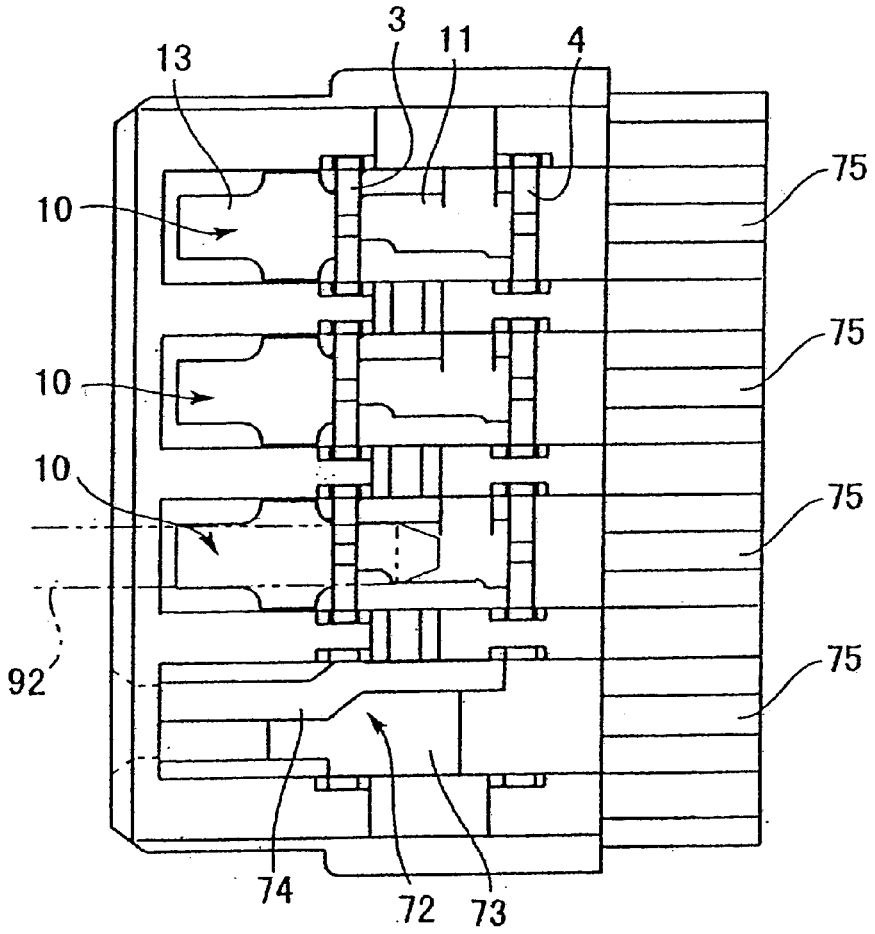
FIG. 7 is a top plan view of connector housing having recesses in which the terminals of FIG. 1 have been placed.

Turning to FIG. 7, a connector housing 71 of the female connector 70 is shown substantially rectangular in plan view and it preferably has a thickness that is slightly greater than a height of the terminal 10. The connector housing 71 is formed of an insulative material such as plastics, a synthetic resin or the like. Four terminal-receiving recesses 72 form compartments in the embodiment shown, into which the terminals 10 are inserted. Then, the wires 8 are connected to the terminals 10 by pressing them into the slots 31, 41 of the wire-contacting elements 3, 4.

As shown in FIG. 7, each recess 72 includes a flat surface 73 for receiving the bottom surface of the second body portion 11 of the terminal 10. It also includes a deep groove 74 alongside the surface 73 for allowing the second contact beam 2 to deflect. The flat surface 73 is designed to supporting the terminal 10 in the recess 72 in a stable manner. The deep groove 74 preferably has a size and a shape so that the spring movement of the second contact beam 2 in the groove 74 is not restricted when it is deflected by the insertion of the associated terminal 92 of the opposing connector shown in FIGS. 8 and 11.

Figure 10:
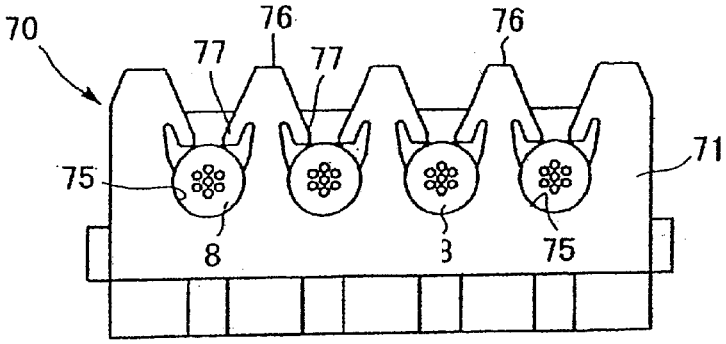
FIG. 10 is a rear elevational view of the connector housing of FIG. 7, taken along lines 10—10 thereof and further illustrating the placement of wires into the connector housing.

As shown in FIG. 10, an additional groove 75 and a wire retaining projection 76 are formed in the rear portion of the connector housing 71 for fastening the wires 8 connected to each terminal 10 in an engagement fashion into the housing 71. Each retaining projection 76 has resilient retainer pieces 77 and 77 located on both sides of the additional groove 75. Thus, the retainer pieces 76 and 77 on both sides of the additional groove 75 are flexible when the wires 8 are inserted into the additional grooves 75 so that the wires 8 may be fixed in the connector housing 71.

FIG. 11 shows a coupled condition of an opposing male connector 90 to the female connector 70 in which the terminals 10 are used. The male connector 90 illustrated may be used as a surface mounting connector for mounting to a substrate, such as a circuit board. The male pin terminal 92 is fixed in the opposing connector housing 91. The housing 91 is formed of insulative material, which the other end portion of the pin terminal 92 projects from the housing 91 to be fixed to the substrate and electrically connected thereto (not shown).

In the coupled condition of the connectors shown in FIG. 11, the male pin terminal 92 is inserted in between the two contact beams 1 and 2 and maintained in an electrically conductive relationship. At this time, the second contact beam 2 is resiliently deflected by the male pin terminal 92 downwardly but the curved lead-in surface 24 remains in intimate contact with the male pin terminal 92 due to the spring nature of the second contact beam 2. The offset aspect of the second contact beams 2 provided by the transition portion 41 increases the spring force and the resistance thereof to ensure more reliable contact that if the second contact beam were straight without the offset.

In this embodiment, where each terminal 10 is inserted into the connector housing 71, after bending on the carrier strip 6 shown in FIG. 6, each terminal 10 is simultaneously pressed an associated connector recess 72 of the housing 71. In this case, the pitch P2 of each terminal 10 is the same as the pitch of each terminal-receiving recess 72, it is possible to incorporate the terminals 10 into the connector 71 having the variety of slots in a simultaneous fashion.

Figure 8:
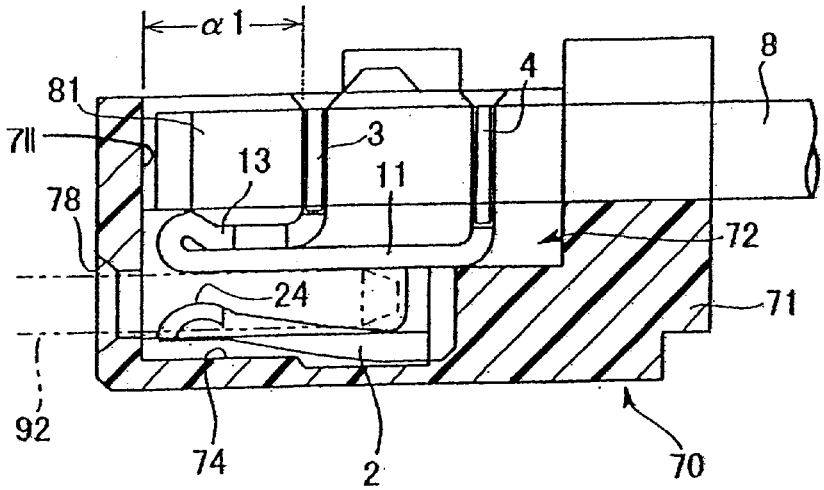
FIG. 8 is a cross-sectional view of the connector housing on FIG. 7, taken along lines 8—8 thereof and illustrating the terminals of FIG. 1 in place within corresponding recesses of the connector housing.
Figure 9:
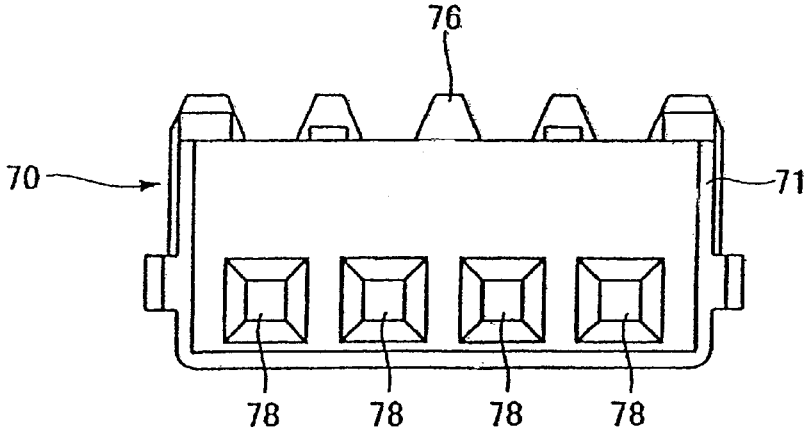
FIG. 9 is a front elevational view of the connector housing of FIG. 7, taken along lines 9—9 thereof.

After the carrier strip 6 is cut off, the wires 8 are pressed against the wire-contacting pieces 3 and 4. At this time, because each terminal 10 is provided with the folded-over first body portion 13 having a length L1 to the terminal IO, not only may the terminal be reduced in size but also as shown in FIG. 8, a sufficient space 1 may be maintained in the recess 72 for accommodating the free end 81 of a wire 8 to facilitate the terminating thereto.

This space 1 is a space formed by an interval between the wire contacting element 3 and the end face 711 of the recess 72. Due to the existence of this space, the workability of the insulation displacement is considerably enhanced. Accordingly, in instances where the terminal 10 is reduced down to a full length of, for example, several millimeters, there is no interference with the workability of the insulation displacement. Furthermore, it is possible to keep a wire end portion 81 having a suitable length that facilitates termination.

Also, due to the folded-nature of the first body portion 13, not only the workability is enhanced, but also the length of the contact beams 1 and 2 may be kept at a desired level. It is therefore possible to increase the effective terminal length with the associated terminal opposing 92. It is thus possible to enhance ensuring an electric conductive state exists.

Also, due to the existence of the folded first body portion 13, the spring force for the first contact beam is strengthened. It is possible to realize a firm two point contact with a simple structure in which the associated terminal 92 is "clamped" between the two contact beams 1 and 2. Accordingly, it is possible to overcome the need for a high precision machining to ensure such rating that has to be performed as in the conventional terminal.

According to the present invention, it is possible to effectively utilize the terminal material using the metal blank while miniaturizing the terminals and the connectors. Also, according to the present invention, it is possible to enhance the assembling property of the terminals, the maintenance of the effective terminal length, the machinability and the like.

FIG. 16 illustrates another embodiment of an insulation displacement terminal 400 constructed in accordance with the principles of the present invention. The terminal 400 is formed from a blank of conductive metal and has a first body portion 401 folded upon a second body portion 402 in a similar manner as the terminal 10 of FIG. 1. The difference in structure with this embodiment is that the offset portion 403 that joins the leg portion 404 to the contact arm 405 of the second contact beam 406 is twisted, rather than bent in an offset manner. This twisting serves to increase the spring force of the second contact beam in a similar manner as the bent transition portion mentioned earlier.

Figure 17:
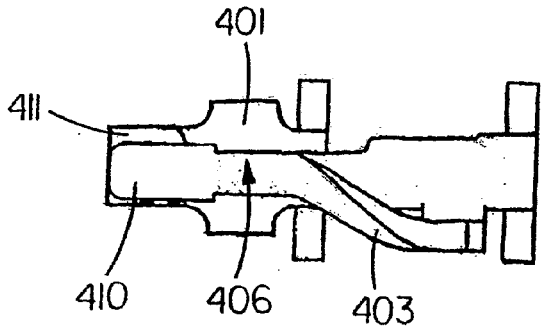

As seen in FIG. 17, which is a bottom plan view of the terminal, the second contact beam ends in a curved guide or lead-in surface 410 that is aligned with the curved guide surface 411 formed by the bending of the first body portion 401 onto the second body portion 402. With the twisting portion 403, the preferred alignment shown is each to achieve.

While the preferred embodiments of the invention have been shown and described, it will be appreciated by those skilled in the art that changes and modifications may be made to these embodiments without departing from the spirit of the invention, the scope of which is defined by the appended claims.

What is claimed is:

1. An insulation displacement terminal for connecting an electrical wire to a terminal of an opposing connector, comprising:

a conductive member, the member including first and second insulation displacement portions, the member being folded upon itself at a preselected foidline of said member such that said first and second insulation displacement portions are spaced apart from each other lengthwise along said member, the foldline defining first and second body portions of said member, the first body portion being folded upon the second body portion to define a first contact beam of said terminal, the first contact beam including opposing first and second ends; and, a second contact beam extending lengthwise alongside said member, the second contact beam including opposing first and second ends, said second contact beam extending generally parallel to said first contact beam and spaced apart therefrom, said first and second contact beams cooperatively defining a terminal-receiving passage therebetween for receiving an opposing terminal of an opposing connector, said second ends of said first and second contact beams respectively defining first and second guiding surfaces of said terminal for guiding said opposing terminal into said terminal-receiving passage.

2. The insulation displacement terminal as defined in claim 1, wherein each of said first and second guiding surfaces are curved.

3. The insulation displacement terminal as defined in claim 1, wherein said first and second insulation displacement portions are aligned with each other lengthwise along said terminal.

4. The insulation displacement terminal as defined in claim 1, wherein said first and second insulation displacement portions are respectively disposed at said first ends of said first and second body portions.

5. The insulation displacement terminal as defined in claim 1, wherein said second contact beam extends lengthwise partially alongside said first contact beam and partially underneath said first body portion.

6. The insulation displacement terminal as defined in claim 1, wherein said first and second contact beams contact said opposing terminal at two points when said opposing terminal is inserted into said passage.

7. The insulation displacement terminal as defined in claim 1, wherein said foldline defines a curved portion of said first contact beam guiding surface.

8. The insulation displacement terminal as defined in claim 1, wherein said first guiding surface is formed along said foldline.

9. The insulation displacement terminal as defined in claim 8, wherein said second contact beam has a free end that is aligned with said first body portion and said second guiding surface is disposed at said free end.

10. The insulation displacement terminal as defined in claim 1, wherein said second contact beam includes a contact an portion and a leg portion interconnecting said contact arm portion to said member.

11. The insulation displacement terminal as defined in claim 9, wherein said contact arm portion is cantilevered from said second body portion by way of said leg portion.

12. The insulation displacement terminal as defined in claim 1, wherein said second contact beam includes a, transition portion that offsets said contact arm portion from said leg portion.

13. The insulation displacement terminal as defined in claim 12, wherein said transition portion is formed by twisting part of said contact arm portion.

14. The insulation displacement terminal as defined in claim 1, wherein said second contact beam is cantilevered from said second body portion.

15. An insulation displacement terminal for providing a connection between a wire having an inner conductive core and an outer insulative covering and a conductive terminal of an opposing connector, the terminal comprising:

an elongated flat, conductive member the member having first and second opposing ends, the member, being folded upon itself to define a folded over portion of said terminal and a first contact beam of said terminal;

first and second insulation displacement portions respectively disposed proximate to said member first and second ends, the first and second displacement portions extending out from said member in opposite directions, such that when said member is folded upon itself, said first and second insulation displacement portions are aligned with each other and spaced apart from each other lengthwise along said member, said folded member defining a first contact beam of said terminal;

a second contact beam extending lengthwise of said terminal and being spaced apart from said first contact beam by an intervening space, said terminal including a leg portion interconnecting the second contact beam and said member, the intervening space defining a terminal-receiving passage for receiving said opposing connector terminal therein.

16. The terminal of claim 15, wherein said second contact beam is cantilevered from said member.

17. The terminal of claim 16, wherein said leg portion extends from said member at a location between said first and second insulation displacement portions.

18. The terminal of claim 15, wherein said second contact beam includes an offset portion interposed between said leg portion and a contact arm portion, the offset portion aligning said second contact beam with said first contact beam.

19. The terminaltenninal of claim 18, wherein said offset portion includes twisted portion.

* * * * *